US005659983A

United States Patent [19]

Coutarel et al.

[11] Patent Number: 5,659,983

[45] Date of Patent: Aug. 26, 1997

[54] DEVICE FOR FILLING IN A TRENCH DUG IN THE SEA BED IN ORDER TO COVER A PIPE LAID DOWN IN THE TRENCH

[75] Inventors: Alain Coutarel, Paris; Christophe Pettenati-Auziere, Neuilly sur Seine, both of France

[73] Assignee: Coflexip, Paris, France

[21] Appl. No.: 522,320

[22] PCT Filed: Jan. 6, 1995

[86] PCT No.: PCT/FR95/00017

§ 371 Date: Nov. 7, 1995

§ 102(e) Date: Nov. 7, 1995

[87] PCT Pub. No.: WO95/18895

PCT Pub. Date: Jul. 13, 1995

[30] Foreign Application Priority Data

Jan. 7, 1994 [FR] France ..... 94 00106

[51] Int. Cl.[6] ..... F16L 1/12; E02F 5/02

[52] U.S. Cl. ..... 37/142.5; 405/163; 37/323

[58] Field of Search ..... 37/142.5, 323, 37/324, 326, 335; 175/102; 405/159, 162, 163, 157, 226, 164; 61/72.4

[56] References Cited

U.S. PATENT DOCUMENTS

| | | | |
|---|---|---|---|
| 3,751,927 | 8/1973 | Perot, Jr. | 61/72.4 |
| 4,091,629 | 5/1978 | Gunn et al. | 405/163 X |
| 4,342,526 | 8/1982 | Mousselli | 405/163 X |
| 4,389,139 | 6/1983 | Norman | 405/163 |
| 4,479,741 | 10/1984 | Berti et al. | 405/162 X |
| 4,516,880 | 5/1985 | Martin | 405/163 X |
| 4,575,280 | 3/1986 | Hemphill et al. | 405/164 |
| 4,749,308 | 6/1988 | Izawa | 405/163 |
| 4,991,997 | 2/1991 | Cowper | 37/323 A |
| 4,992,000 | 2/1991 | Doleshal | 405/163 |
| 5,288,172 | 2/1994 | Reuhl | 405/163 |

OTHER PUBLICATIONS

Patent Abstracts of Japan, vol. 5 No. 119(M–081), Jul. 31, 1981 & JP,A,56 059932.

Patent Abstracts of Japan, vol. 8 No. 174 (M–316) 1611, Aug. 10, 1984 & JP,A,59.

*Primary Examiner*—Terry Lee Melius

*Assistant Examiner*—Robert Pezzuto

*Attorney, Agent, or Firm*—Schweitzer Cornman Gross & Bondell LLP

[57] ABSTRACT

An improved trench-filling device for covering a pipe and filling in a trench dug in a sea bed, characterized in that the device comprises two sets of nozzles (6,7) arranged above and proximate to the sea bed on both sides of the trench (1), the nozzles pointing towards the sea bed and towards the trench and being fed with pressurized water to direct powerful jets of water into the ground making up the sea bed adjacent the trench to deposit into the trench constituent parts of the adjacent ground as the trench-filling device progresses along the trench, and guides (14, 14') provided above to channel the high pressure jet streams created by the nozzles (6,7).

21 Claims, 6 Drawing Sheets

DEVICE FOR FILLING IN A TRENCH DUG IN THE SEA BED IN ORDER TO COVER A PIPE LAID DOWN IN THE TRENCH

BACKGROUND OF THE INVENTION

The present invention relates to a device for filling in a trench dug in the sea bed in order to cover up a pipe laid down in the said trench.

In the sense of the present invention, pipe is understood to be a rigid or flexible tubular conduit, a conduit including a bundle of conduits of the umbilical type, an electric power cable or a cable for transmitting signals, or a collection of such conduits or cables arranged side by side.

It is often necessary to afford protection to underwater pipes by burying them below the surface of the sea bed, especially in order to protect them from objects likely to damage them such as the anchors of ships, trawling nets, etc., and to keep the pipe still while placing it out of reach of the action of currents and the swell.

The use in this context of machines known as burying machines is known, these making it possible to dig a trench in the sea bed by mechanically cutting into the sea bed and/or by deaggregating the latter using jets of pressurized water, the burying machines being towed from the surface or being self-propelled and controlled remotely from a vessel on the surface. The burying operation may be carried out at the same time as the operation of laying the pipe on the sea bed, as described for example in the prior patents of the filing company FR-A-2,455,235 and FR-A-2,475,681, or alternatively be carried out subsequently, after the pipe has been laid on the sea bed beforehand.

To the end of improving the protection of the pipe, the latter is commonly laid down a certain distance below the surface of the sea bed.

It is hence necessary to dig trenches in the sea bed, the depth of which trenches in practice is of the order of 1 meter, but may sometimes reach or exceed 2 meters depending on the diameter of the pipe to be buried and the desired depth of burying.

Depending on the characteristics of the ground forming the sea bed, hard or soft, and on the technique used to make the trench, the latter may exhibit a more or less narrow and deep substantially rectangular cross-section or quite an open V-shaped cross-section or alternatively any other intermediate shape.

The trench may in some cases be filled in spontaneously to a more or less partial extent, but insofar as the thickness of the material thus deposited, even though it may be relatively significant in places, varies unpredictably and in a way which cannot easily be monitored, it is necessary to ensure the total filling-in of the trench in a reliable fashion, particularly in the case of ground which is not very highly consolidated.

The complete covering of a pipe up to the level of the surface of the sea bed makes it possible, particularly in the case of pipes for conveying fluids such as hydrocarbons at high temperature and under high pressure, to limit the development of loops which might be formed by buckling owing to the increase in length of the pipe under the effect of temperature and/or pressure.

The burying of the pipe further makes it possible to improve its thermal insulation.

Various devices making it possible to fill in to a greater or lesser extent a trench dug in the sea bed are already known.

Thus, equipment is known which includes blades which scrape the sea bed over a certain width, like the civil engineering works machines of the "scraper" type. Such equipment makes it possible to clear and to convey, in order to deposit them in the trench, quantities of materials coming from the sea bed, particularly some of the spoil deposited at the sides on either side of the trench during the prior digging operation, as well as constituent parts of the ground extracted mechanically from the superficial part of the sea bed on either side of the trench.

Such equipment is bulky and heavy, expensive to produce and to use and requires high traction forces to move it along the trench to be filled in.

It has moreover been proposed (JP-A-56 59932) to fill in a trench dug for laying a conduit, by spraying pressurized water using two nozzles arranged on either side of the trench at the back of the burying machine, and pointing backwards so as to return towards the trench constituent parts of ground removed from the banks which have been formed on each side of the trench by the spoil deposited at the side when the said trench was being dug. The effectiveness of such a device is very slight and a very small, uneven and random proportion of the back-fill materials reaches the bottom of the trench in order to cover the conduit, which does not allow the said trench to be filled in satisfactorily, it even being possible, in some circumstances, for the device to widen the trench instead of filling it in.

SUMMARY OF THE PRESENT INVENTION

The present invention intends to provide a device for filling a trench dug in the sea bed, in order effectively to cover a pipe laid down in the said trench, which is light, relatively economical and easy to produce and to put in place, and which puts up very little resistance against progressing along the trench to be filled in.

The device according to the present invention is essentially characterized in that it comprises two sets of nozzles arranged a small distance above the sea bed on either side of the said trench dug therein, the said nozzles pointing towards the sea bed and towards the said trench and being fed with highly pressurized water in order continuously to spray jets of water into the ground making up the sea bed on either side of the trench, so as to deposit constituent parts of the said ground in the trench as the device progresses along the trench and in this way at least partially fill the latter in, guide means being provided to channel the flows created by the nozzles.

In the sense of the invention, constituent parts of ground are understood to mean constituent parts of the sea bed in place on either side of the trench, as well as the spoil arranged in ridges on either side of the trench, and originating from the prior digging of the trench.

The nozzles according to the invention are arranged so that their mouths are situated at a height less than 50 cm, and preferably less than 10 cm with respect to the sea bed.

The mouths of the nozzles are, in fact, preferably situated as close as possible to the sea bed, it even being possible for the mouths of some nozzles, especially at the back of the device, to be below the surface of the sea bed.

The axis of each nozzle advantageously makes an angle of between 5° and 80°, and preferably between 10° and 60° with respect to the horizontal.

The sets of nozzles are preferably symmetric to each other with respect to a vertical mid-plane of the device.

For preference, the nozzles point backwards with respect to the direction of progression of the filling-in device according to the invention and advantageously form an angle of between 5° and 80° and in particular between 20° and 60° with respect to a vertical plane perpendicular to the vertical plane of symmetry of the device.

The axes of the nozzles of each of the two sets may all be mutually parallel, in two directions respectively symmetrical with respect to the vertical plane of symmetry of the device. As an alternative, the axes of the two sets are respectively arranged in two oblique planes which are inclined with respect to the horizontal, but exhibit varied values for the angles of orientation with respect to the plane of symmetry. In particular, the angle of orientation of the various nozzles with respect to a vertical plane perpendicular to the vertical plane of symmetry may increase uniformly from the front backwards.

In another alternative, the axes of each of the two sets are contained within respectively parallel vertical planes, but they exhibit varied angles of inclination with respect to the horizontal, particularly values which increase uniformly from the front backwards.

Depending, in particular, on the nature of the ground fondling the sea bed, as well as on the dimensions of the trench, it is possible to optimize the characteristics of the device, such as the number, arrangement, and angles of orientation of the nozzles, so that the device is able to cover the pipe uniformly.

In a first embodiment, the means for guiding the flows created by the nozzles comprise a set of guide nozzles which are fed with pressurized water and point backwards. With respect to the two sets of main nozzles which fill in the trench, the guide nozzles are arranged above, at a height preferably of between 10 cm and 1 m, and along the entire length of the region occupied by the main nozzles. The guide nozzles may be roughly arranged in one and the same horizontal plane or alternatively at varied heights, exhibiting a symmetric configuration with respect to the mid-plane of symmetry of the device, the central guide nozzles then being raised up with respect to the side guide nozzles.

Advantageously, the axes of the guide nozzles are horizontal, or have a slight inclination with respect to the horizontal plane of the bed, preferably less than 10°. Advantageously, the axes of the guide nozzles are parallel to the mid-plane of symmetry. As an alternative, the axes may exhibit angles of values which are symmetric with respect to the mid-plane of symmetry, preferably less than 20°, and point, in a slightly convergent manner, towards the back and the outside of the device.

The jets of water emitted by the guide nozzles, by reaction, create a forwards thrust force which is applied to the device and the horizontal component of which can be used to produce all or some of the propulsive effort allowing the device to progress along the pipe.

In a second, preferred, embodiment, the guide means include a hood covering the space delimited by the sets of nozzles and allowing the channelling of the liquid flows brought about by the action of the jets leaving the nozzles in the space lying between the sea bed and the hood.

In the sense of the present invention, hood is understood to be a structure capable of forming a screen above the flows created by the nozzles in order to channel these flows. This screen defines a surface for separation with regard to the mass of water surrounding it, it being possible for this separation surface to be leaktight or nonleaktight, continuous or noncontinuous, it being understood that what is required for satisfactory implementation of the invention is for the flow rate of water capable of passing through this separation surface to be limited, especially preferably less than half the total flow rate of the jets of water emitted by the nozzles.

The hood may consist of a continuous or discontinuous flexible structure, such as for example fabric, canvas, tapes or strips, the structure being held by positioning elements arranged on at least part of its periphery, such as hallasting elements, or rigid elongate elements forming a peripheral frame.

The flexible structure forming the hood may also, in the case mentioned later in which the sets of nozzles are produced in hollow arms, be positioned fixed to these hollow arms which may themselves be made of a flexible or rigid material, or be elongate elements of the peripheral frame mentioned above.

The flexible structure may be stiffened by elongate structural elements acting in the manner of the ribs of an umbrella.

According to the invention, the hood may equally well be made mainly or exclusively of rigid elements, such as continuous or perforated, leaktight or nonleaktight plates, meshes or elongate structural elements.

For preference, the hood includes a central part connected to two side parts which extend as far as the sets of nozzles, the central part of the hood above the trench being arranged at a greater height than the said side parts.

The hood is preferably supplemented on each side by two external sidewalls arranged outside the mouths of the sets of nozzles with respect to the direction of the nozzles pointing towards the trench.

Advantageously, the hood is supplemented by a front wall and a back wall arranged between the front and back end edges of the hood and the sea bed. The front and back walls advantageously include an opening, interrupting the lower edge of the walls in its central part.

The device may further include a longitudinal central partition arranged beneath the said hood, the height of the said partition being less than or equal to the heightwise gap separating the hood from the sea bed.

The hood may equally well consist of a combination of rigid elements such as plates, and flexible elements such as fabric or canvas. Thus, for example, the two side parts and possibly also the external sidewalls may consist of rigid elements, the central part consisting of flexible elements.

In another embodiment, the device includes vertical or oblique structural elements arranged above the sea bed in the central part of the space delimited laterally by the two sets of nozzles which fill the trench in. For preference, the height of the said structural elements above the sea bed is less than half the transverse distance between the two sets of nozzles perpendicularly to the plane of symmetry of the device.

When a hood is provided, the said structural elements are arranged beneath the said hood, in its central part, the height of the said structural elements being less than or equal to the heightwise gap separating the hood from the sea bed.

The structural elements are not continuous so as to allow the stream of mud flowing between the hood and the sea bed to pass through, but they constitute an obstacle with respect to this flow in the manner of chicanes. They may be made in the form of a plurality of flat or curved separate elements, such as narrow blades of greater or lesser height, such as fins, pointing vertically or obliquely. Use may equally well be made of substantially cylindrical, advantageously rigid, elements such as rods or of non-rigid such elements which can curve to a greater or lesser extent under the effect of the liquid stream, like brush bristles for example. As an alternative, the structural elements may be perforated continuous elements, such as perforated plates.

Viewed in plan, these distinct structural elements or the perforations in the plates may be offset in a staggered configuration in order to force the stream to follow a winding path.

Such structural elements promote the slowing-down of the stream of water laden with particles of ground and may contribute to increasing the amount of ground deposited in the trench and/or to reducing the bulk of the device.

The device according to the present invention, as it progresses along the trench, deaggregates and extracts the constituent parts of ground in place close to the trench and/or the possible ridges of residue situated along the edges of the trench and resulting from the prior operation of digging the trench. These constituent parts of ground and/or the residues are then placed in suspension and transported by the water flows emitted by the nozzles, and are then deposited in the trench by settling-out so as to cover uniformly the pipe in place in the trench. The orientation of the liquid flows is progressively modified, nearing the mid-plane of the device in order to become substantially parallel to the direction of the trench, at the same time as the rate of flow is considerably reduced in the central part of the device.

The means for guiding the flows, provided according to the invention, promote uniformity of the flows, without parasitic swirling, and the slowing-down of the flow above the trench.

For preference, according to the invention each of the sets of nozzles is made in the form of at least one row, the rows of the two sets of nozzles, which rows are arranged on either side of the trench, preferably exhibiting symmetry with respect to a vertical plane.

The filling-in operation may be carried out by positioning the plane of symmetry of the device so as to cause it to contain the axis of the pipe to be covered.

The calibrated mouths of the nozzles of each row are advantageously arranged in line or substantially in line along a straight line parallel to or slightly inclined with respect to the plane of the sea bed, the said straight line forming an angle preferably less than 60° and particularly less than 50° with the plane of symmetry of the device.

In a particular embodiment of the device of the invention, the water flow rate required for the nozzles of one and the same row is provided by one and the same conduit fed with highly presurized seawater.

In a particular embodiment, the nozzles of one and the same row are mounted in line along a hollow arm and are arranged in advantageously straight parts of the arms. The arms serve to support the nozzles and to convey the pressurized water and are produced so as to exhibit sufficient rigidity to ensure correct positioning of the nozzles with respect to the trench, taking account of the weight of the equipment and of the loadings exerted, particularly by the reaction of the jets.

In an alternative embodiment, the device further comprises balancing nozzles, pointing towards the outside of the device, and preferably exhibiting an upwards and outwards inclination.

Advantageously, the balancing nozzles may be mounted on the hollow arms serving as support for the main nozzles and fed with highly pressurized water. The mouths of the balancing nozzles are arranged outside the elements forming the device according to the invention, particularly outside the external sidewalls of the hood, when a hood is provided.

The anterior part of the hollow arms, in the direction of progression of the device along the trench, is mounted at the back of a moving chassis supporting the device and including at least one pump, it being possible for this mounting to be fixed, or articulated and rotary, for example a rotary mounting of horizontal axis with a rotating seal for the passage of water from the pump or pumps so as to allow the device according to the invention to be tilted and raised vertically with respect to its supporting chassis.

As an alternative, the pump or pumps may be mounted, not on the moving chassis, but on a vessel monitoring the operations and remotely controlling the moving chassis from the surface, the pump or pumps being linked to the moving chassis, particularly by a conduit conveying the pressurized water.

The hollow arms are advantageously open at their anterior part in order to link the internal volume of the arms to pipes linked to the pump or pumps mounted on the moving chassis for feeding the nozzles with water, and being closed at the back so as to distribute the flow rate from the pump or pumps between the nozzles mounted on the arm.

According to an advantageous embodiment, the device according to the invention includes at least two hollow arms which are symmetrical with respect to the vertical mid-plane of the device, the nozzles borne respectively by the two arms also being symmetric with respect to the said vertical plane of symmetry of the device.

The two arms are arranged in a plane substantially parallel to the sea bed when they are installed in the working position.

In general, it is preferable to prevent the various parts of the device which are situated close to the sea bed from penetrating into the sea bed, while reducing to a minimum the vertical distance that may separate the lower edges of these parts of the device from the bed.

In practice, the distance between the lower edges of the various parts of the device and the surface of the sea bed is nil or of the order of a few centimeters, preferably less than 10 cm.

According to a first embodiment, the device for filling in a trench according to the invention may be hitched up to the burying machine used simultaneously for digging the trench, this machine then constituting the moving chassis supporting the device and preferably including the pump or pumps feeding the nozzles with water.

In this case, it is appropriate to arrange the active part of the arms bearing the nozzles at a sufficient distance behind the burying machine for the intermediate part of the pipe, which has an S-shaped curvature between the part laid on the bed at the front and the part laid in the trench at the back, to be positioned ahead of the nozzles so that the filling-in of the trench starts from the point where the pipe has reached the bottom of the trench.

In a second, preferred, embodiment, the filling-in operation is carried out separately, after the trench has been dug, the pipe having been laid down in the trench beforehand either in a simultaneous combined operation of laying from the laying vessel and digging of the trench by the underwater digging machine, or in a separate digging operation carried out after or before the pipe has been laid on the bottom from the laying vessel.

The filling device is then mounted as mentioned before at the back of a moving chassis able to be moved along the bed progressing above the trench, it being possible for this moving chassis to be of any known type, for example of the type having tracks, wheels, or side skids, and may either be towed from a vessel, or self-propelled and remote-controlled from the surface.

Owing to the fact that the trench-filling operation, particularly including the deaggregation of the ground, is carried out by virtue of the device according to the invention without offering resistance to its progression, by contrast with that which was the case for machines of the "scraper" type, and that the device has a low weight, which may furthermore again be compensated for by buoyancy elements, as well as a relatively limited bulk, a lightweight, compact and economical moving chassis may be used to employ it.

This advantage is particularly significant in the case where the trench has been dug also using such a lightweight chassis, something which is possible if a trench-digging device operating by the "jetting" effect, with nozzles making it possible to spray jets of highly pressurized water for deaggregating the ground is associated with the chassis.

It is thus possible to carry out all of the operations of digging, then subsequently filling-in the trench using exclusively lightweight compact devices, which particularly makes it possible to carry out all the underwater work from a specialized vessel of relatively limited dimensions by comparison with the very large barges or vessels equipped with powerful handling means which are necessary for manipulating the heavy underwater mechanical digging equipment of the "scraper" type.

The trench-filling device according to the invention may, in practice, be mounted in place of the digging device using jetting on the same lightweight moving chassis used for the preliminary operation of digging the trench.

Advantageously, the mounting of the device according to the invention on the moving chassis includes a rotary assembly of horizontal axis with preferably a rotating seal for the passage of the water from the pump or pumps so as to be able to tilt and vertically lift the device. Handling on board the vessel and launching of the device passing through the air/water interface are carried out in the folded-up position, in order to reduce the bulk and limit the reactions of the water and the effects of the swell which make the operation more difficult. The device may then be tilted and placed back into the horizontal working position when it is laid on the bed, it thus being possible for the device to be mounted in a fixed manner by being built into the moving chassis in cantilever fashion.

The device may be made as two symmetrical halves joined together along the mid-line of the central part of the hood in particular, these two halves can be hinged together about a horizontal axis, which makes it possible to reduce the bulk of the device for handling and launching by folding the two halves back against each other.

As an alternative, the hood and the walls associated with it may be made in the form of a folding assembly including elements which can turn about an axis, for example vertical, so as to reduce the surface area subjected to hydrodynamic effects.

The device according to the invention may be connected to the moving chassis by a rotary coupling of horizontal axis perpendicular to the mid-plane of symmetry of the device so as to be able to turn about the said axis. The device may thus include a rear support member, for example two side wheels allowing it to follow any possible irregularities of the sea bed. The device may equally well include a ram between a point of attachment on the moving chassis and a retaining point on the device in order to control the inclination thereof.

According to another embodiment, the device may be produced using flexible, inflatable structure techniques, the rigid arms being replaced by leaktight flexible tubes which are stiffened under the effect of the pressure of water coming from the pump or pumps. It is thus possible to reduce the bulk of the device during launching and descent. The slight overpressure in the volume of water trapped under the hood allows the various flexible elements forming the structure of the device to be tensioned and stiffened, and for its weight to be compensated for. The side and front edges of the device may follow the level of the sea bed, mating with it exactly without the risk of scraping the ground.

The filling-in device according to the invention can be used in all cases where the sea bed is of a nature that can be deaggregated by spraying jets of highly pressurized water, that is to say in the case of loose, unconsolidated ground, or ground which is not highly consolidated, particularly in the case of powdery ground such as sand, or coherent ground such as clay or a ground combining these two types of material.

However, the device according to the invention may equally well be used for filling-in a trench made in a consolidated ground, insofar as a sufficient amount of residue from the trench-digging operation remains deposited along the edges of this trench, or alternatively if a superficial part of the sea bed is loose enough that it can be deaggregated by the jets sprayed by the device.

Further advantages and characteristics of the present invention will emerge from reading the description which follows of non-limiting embodiments with reference to the appended drawing in which:

DETAILED DESCRIPTION OF THE INVENTION

Figure 1:
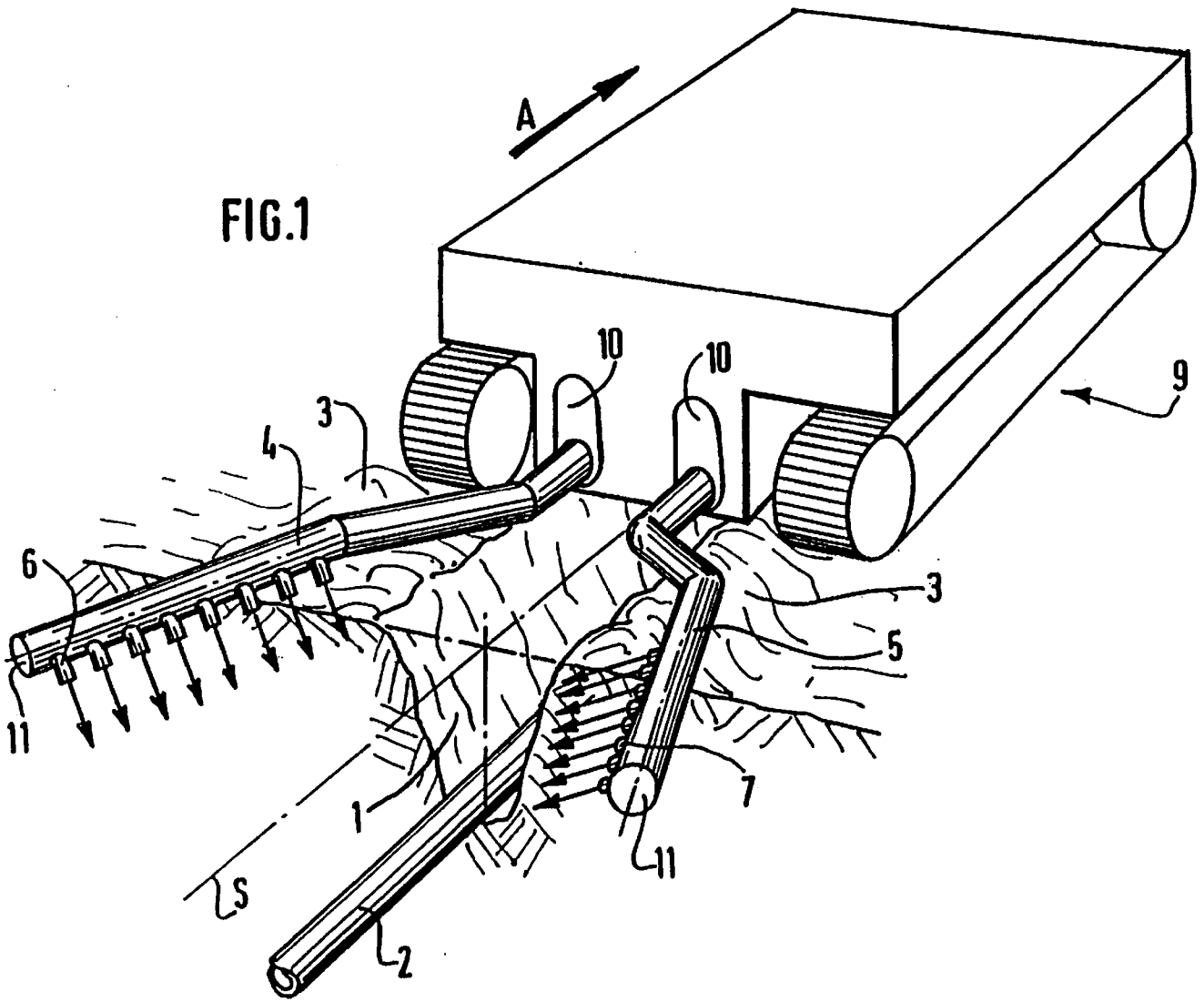
FIG. 1 diagrammatically illustrates the device according to the invention, the means for guiding the flows not being illustrated, for greater clarity.
Figure 2:
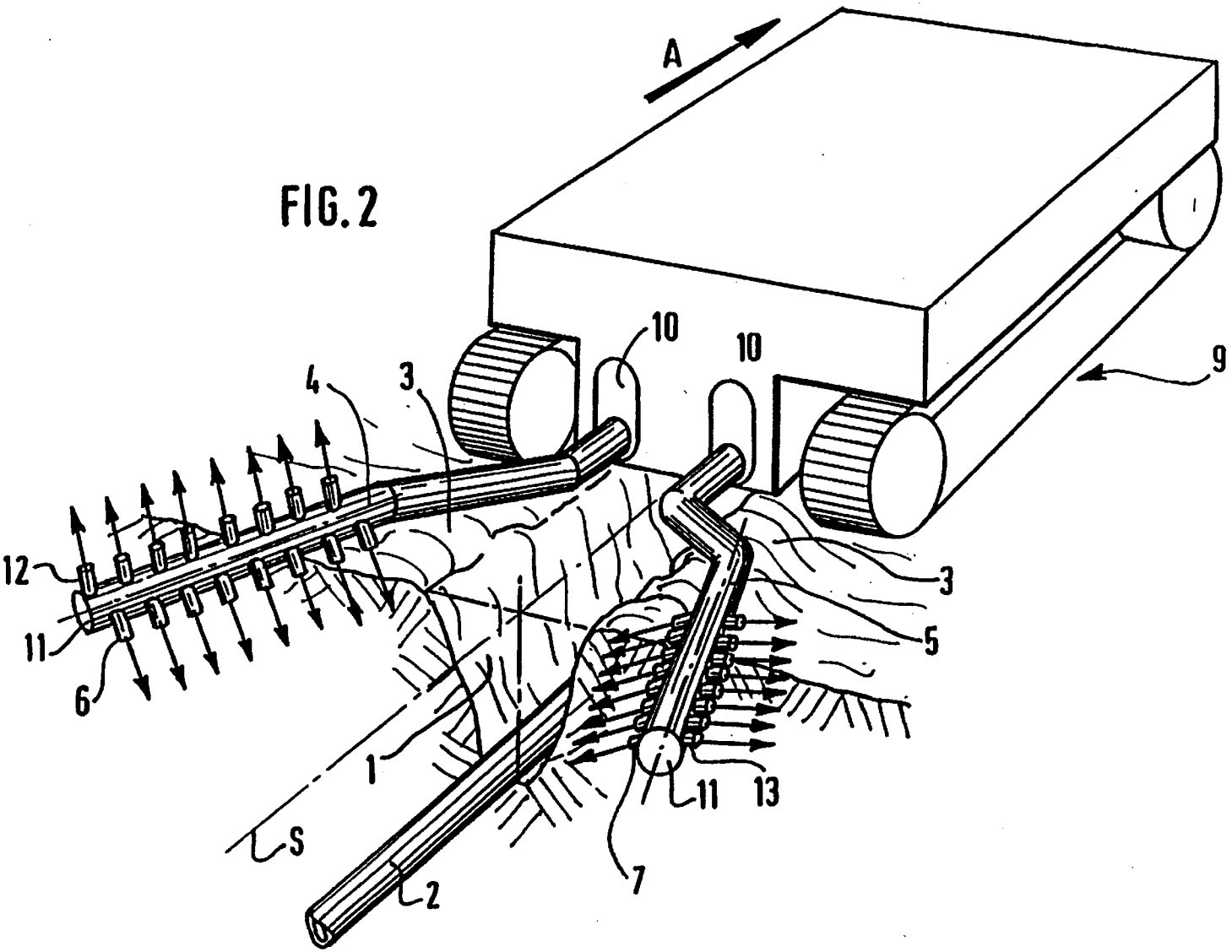
FIG. 2 is a view similar to FIG. 1 of an alternative embodiment, FIG. 3 diagrammatically illustrates one embodiment of the device according to the invention.

Reference is firstly made to FIGS. 1 and 2.

Visible therein, in transverse section, is a trench 1 dug in loose ground such as sand, unconsolidated clay or a mixture of the two, mud silt, etc. A pipe 2 rests at the bottom of the trench, possibly covered with a limited thickness of the material which has been extracted from the sea bed by the trench-digging machine and which has fallen back into the trench behind the machine as it progresses along or which has been entrained progressively, originating from the superficial part of the sea bed under the action of the currents or swell, or which has fallen back into the trench by natural collapse of its walls.

On each side of the edges of the trench there can be seen regions of disturbed ground 3 extracted during the trench-digging operation, and thrown up sideways by the digging machine and redeposited under a settling effect in the form of ridges along the edges of the trench. Depending on the characteristics of the ground, on the technique used for digging and removing spoil and on the conditions of currents and the swell, these regions 3 of spoil may be of greater or lesser size, or absent in some cases.

The cross-section of the trench has a flared overall shape, the slope of the sidewalls particularly depending on the degree of the angle of natural slope which characterizes the ground. Thus, at the surface, the trench has a width substantially greater than that at the bottom of the trench, the latter width being determined so as to be able to accommodate the pipe 2. Depending on the depth chosen for the trench, and particularly on the nature of the ground, the width of the trench at the surface of the sea bed may be of the order of 0.5 m to 2.5 m or more.

It should be clear that the device according to the invention is not limited to use with a trench as illustrated and may be employed especially with a trench dug in consolidated ground which then has a narrower shape with sidewalls which may, in very compact ground, be substantially vertical.

In the case of relatively loose ground, the trench illustrated in the drawing may advantageously be dug by a lightweight machine operating using the jetting principle, that is to say spraying jets of highly pressurized water for digging the ground.

In the case of consolidated ground, the trench may be dug by a machine on wheels or on chains carrying picks, of any known type.

The device illustrated includes two hollow arms 4 and 5, each arm being equipped with a plurality of nozzles 6 and respectively 7, each exhibiting a calibrated mouth.

The arms 4 and 5 are made in the form of rigid tubes, for example made of steel, aluminium, or plastic.

The arms 4 and 5 at the same time serve as supports for the nozzles 6 and 7 and as conduits for conveying pressurized water to the various nozzles, the anterior end of the arms, in the direction of progression of the device represented physically by the arrow A in FIGS. 1 and 2, being linked to a moving support chassis denoted by 9 overall and illustrated very diagrammatically.

In the embodiment illustrated this is a tracked chassis forming part of equipment as will be described in more detail with reference to FIGS. 5 and 6.

The connecting of the arms 4 and 5 to the moving chassis 9 takes place advantageously by means of connecting members such as flanges represented diagrammatically at 10.

The posterior end 11 of the hollow arms 4 and 5 is closed.

The nozzles 6 and 7 are arranged in the form of symmetric rows with respect to a vertical mid-plane of the device represented physically in the drawing by its line S in the plane which the surface of the sea bed approximately forms, and which is horizontal in the typical case illustrated in FIGS. 1 and 2. The device may naturally be employed on sea beds with a higher or lesser degree of unevenness, or slightly sloping sea beds.

The axes of the nozzles preferably point backwards.

The calibrated mouths of the nozzles are preferably arranged as close as possible to the sea bed.

The distance between the calibrated mouths of the nozzles and the vertical plane of symmetry of the device is chosen on the basis of the width that the trenches to be filled in may exhibit, so that the nozzles can be arranged on the outside of the edges of the trench 1. For preference, a gap is left between the calibrated mouths and the edges of the trench so that the calibrated mouths of the nozzles remain on the outside of the side regions where ground 3 is deposited, and so that the Jets of water leaving the nozzles can effectively deaggregate and entrain some of the underwater ground into place.

In the examples illustrated, the active parts of the arms 4 and 5 which support the nozzles 6 and 7 are made in the form of two cylindrical tubes of circular cross-section, the distance between the two tubes increasing from the front backwards.

The arms 4 and 5 thus delimit a surface of trapezoidal shape.

In the alternative embodiment illustrated in FIG. 2, the device comprises two sets of balancing nozzles 12 and 13 pointing towards the outside of the device, for example lying within a plane perpendicular to the plane of symmetry of the device, and preferably exhibiting an upward and outward inclination.

The sets of balancing nozzles 12 and 13 are mounted respectively on the arms 4 and 5 and supplied with highly pressurized water by the internal conduit of each am in the same way as the sets of main nozzles 6 and 7 mentioned earlier.

The jets of water emitted by the balancing nozzles make it possible, on the one hand, to balance out completely or in part the vertical component of the thrust exerted by the main nozzles which tends to lift the device compensating for its apparent weight in water and, on the other hand, compensate for the outwards sideways thrust exerted by the main nozzles.

Furthermore, the balancing nozzles make it possible, by drawing off some of the total flow rate delivered by the pump or pumps (not represented) mounted on the moving chassis 9, to set the water flow rate of the main nozzles to the optimum value.

This advantage is particularly beneficial in the case where the moving chassis 9 fox-ms part of a machine, like the one which will be described later with reference to FIGS. 5 and 6, which constitutes the machine for the prior digging of the trench, using the pump or pumps available on the said machine and used beforehand for the digging when these pumps have a delivery which is in excess of the optimum value for correct operation of the filling-in device according to the invention.

Figure 3:
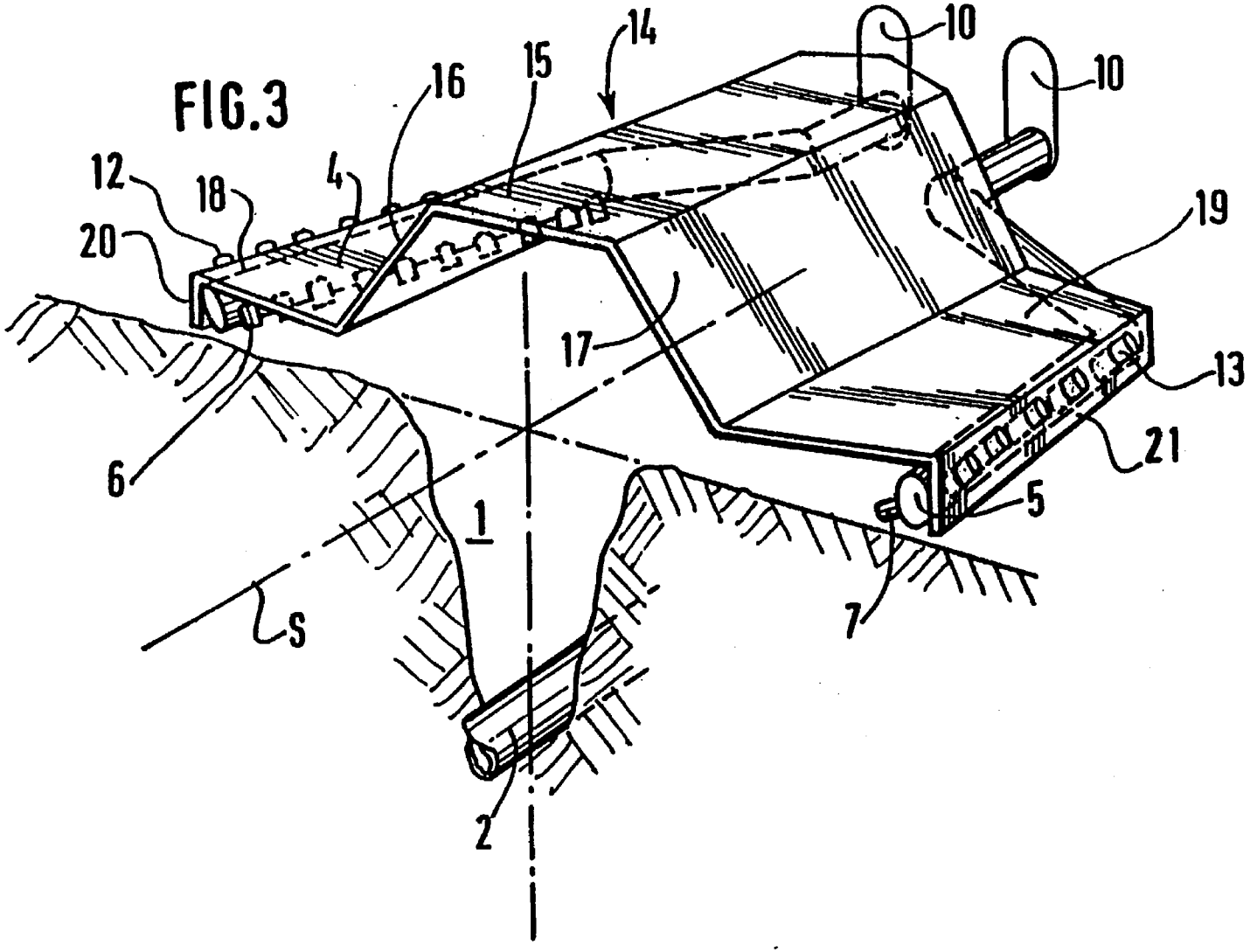

Reference is now made to FIG. 3.

The device illustrated therein comprises, in addition to the arms 4 and 5 equipped with the nozzles 6 and 7, a covering hood denoted by 14 overall.

This hood 14 which covers the trapezoidal surface delimited by the arms 4 and 5 has an overall configuration which is symmetric with respect to the plane of symmetry of the device.

For preference, the surface covered by the hood, in horizontal projection, completely encompasses the surface delimited by the two sets of nozzles 6 and 7, the hood advantageously including a part overhanging backwards and a part overhanging forwards with respect to the surface delimited by the nozzles.

The hood 14 has a central part 15 which is flat and preferably horizontal as illustrated, or is roof-shaped, joined by inclined intermediate parts 16 and 17 to horizontal side parts 18 and 19.

The height of the central part 15 of the hood 14 above the surface of the sea bed is preferably two to six times greater than the height of the side parts 18 and 19 with respect to this surface of the sea bed.

The intermediate parts 16 and 17 form inclined surfaces the slope of which is preferably between 20° and 70°, particularly 40° to 50°.

Two external sidewalls 20 and 21 extend over a length at least equal to the total distance covered by the set of nozzles mounted on the arms 4 and 5 and are arranged so that the mouths of the nozzles 6 and 7 are situated inside the space which they delimit.

In the example illustrated, the device also includes balancing nozzles 12, 13, the mouths of which are arranged on the outside of the external sidewalls 20 and 21.

The top edge of the external sidewalls 20 and 21 is preferably connected to the outside edge of the side parts 18 and 19 of the hood and their lower edge is situated level with the surface of the sea bed, or slightly above.

The sidewalls 20 and 21 prevent sideways flows of water towards the outside in the space between the sea bed and the hood and improve the effectiveness of the device.

In embodiments, not represented, they may however be omitted. Their function which consists in laterally delimiting the volume of water situated between the arms 4 and 5 and under the hood 14 may be fulfilled simply by the arms 4 and 5, by designing the shape and height of their cross-section appropriately, the outside edges of the side parts 18 and 19 then being connected to the upper generatrix of the arms 4 and 5.

The width of the central part 15 of the hood 14 corresponds substantially to the width of the central strip of ground deposited and covering the pipe 2.

In the case illustrated in which the trench I is flared and relatively wide, at its top part, this strip of ground forms a ridge hemmed in by two lower side regions similar to furrows, the trench not having been filled completely by the filling-in operation. This does not prevent the pipe from being covered uniformly, and entirely satisfactorily.

The width of the central part 15 of the hood 14 may be determined so that the width of the central strip of ground deposited is sufficient relative to the width occupied by the pipe 2, especially equal to one or two times this width. The width of the side parts 18 and 19 of the hood is preferably between 25 and 70% of the shortest geometric distance between the mouths of the nozzles 6 and 7 and the plane of symmetry of the device.

Figure 4:
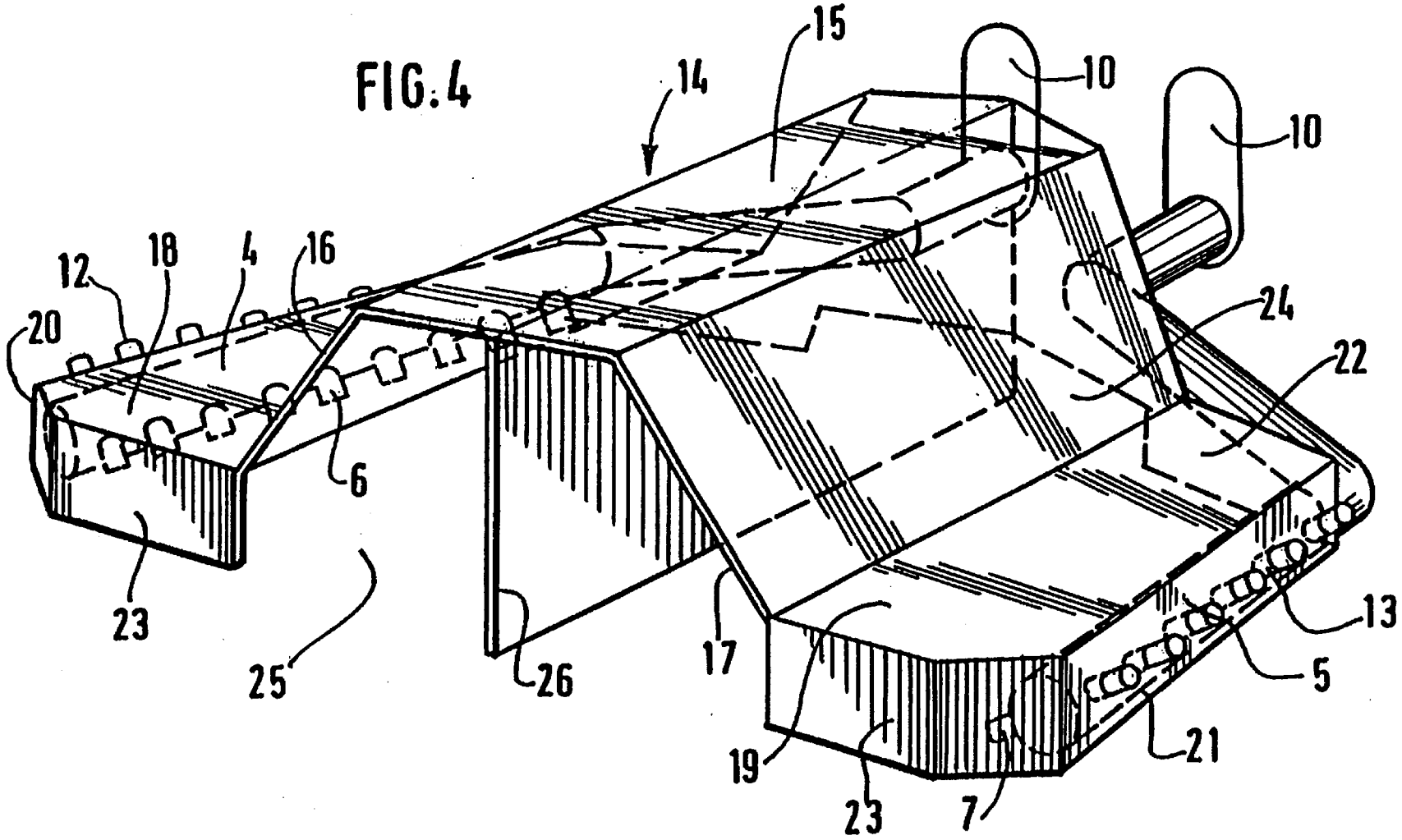
FIG. 4 is also a diagrammatic view illustrating another embodiment of the device according to the invention.

In the embodiment illustrated in FIG. 4, the hood is supplemented by a front wall 22 and a back wall 3 each exhibiting a central opening 24 and respectively 25, which extend from the lower edge of the walls 22 and 23 over some or all of their height. The front and back walls 22 and 23 may be vertical or slightly inclined.

The back wall 23 is arranged under the back edge of the hood 14 between the arms 4 and 5, behind the last nozzles 6 and 7, and preferably between the two external side walls 20 and 21.

The lower edge of the back wall 23 is arranged just touching the sea bed and is interrupted by the opening 25 which has a width which may be of the order of magnitude of the width of the central part 15 of the hood 14. In the embodiment illustrated in FIG. 4, the opening 25 occupies the entire height under the hood 14 in the central part 15 and the intermediate parts 16 and 17 thereof. The back wall is thus reduced to exhibiting two portions which run around the space under the side parts 18 and 19 of the hood above the surface of the sea bed.

The opening 25 in the back wall 23 facilitates the backwards discharge along the trench of the flow rate of fluid given by the flow rate of water from the nozzles 6 and 7 increased by some of the ground which has been extracted and carried along by the jets and has not yet been deposited in the trench before leaving the region delimited by the back wall 23.

The front wall 22 is arranged under the front edge of the hood 14 between the arms 4 and 5, ahead of the two first nozzles 6 and 7, preferably between the external sidewalls 18 and 19.

The lower edge of the front wall 22 is arranged just touching the surface of the sea bed and is interrupted by the opening 24 which is made in the wall, above the surface of the sea bed, and increases the effectiveness of the filling-in device by allowing a certain amount of seawater to flow from the front towards the region covered by the hood 14, this flow rate of water combining with the flow emitted by the nozzles. Furthermore, this opening allows the ridges 3 of ground which may exist, resulting from the previous trench-digging operation to pass freely.

In the embodiment of FIG. 4, also provided is an axial partition 26 arranged in the plane of symmetry of the device between the central part 15 of the hood and the surface of the sea bed and between the front and back edges of this central part 15.

Figure 5:
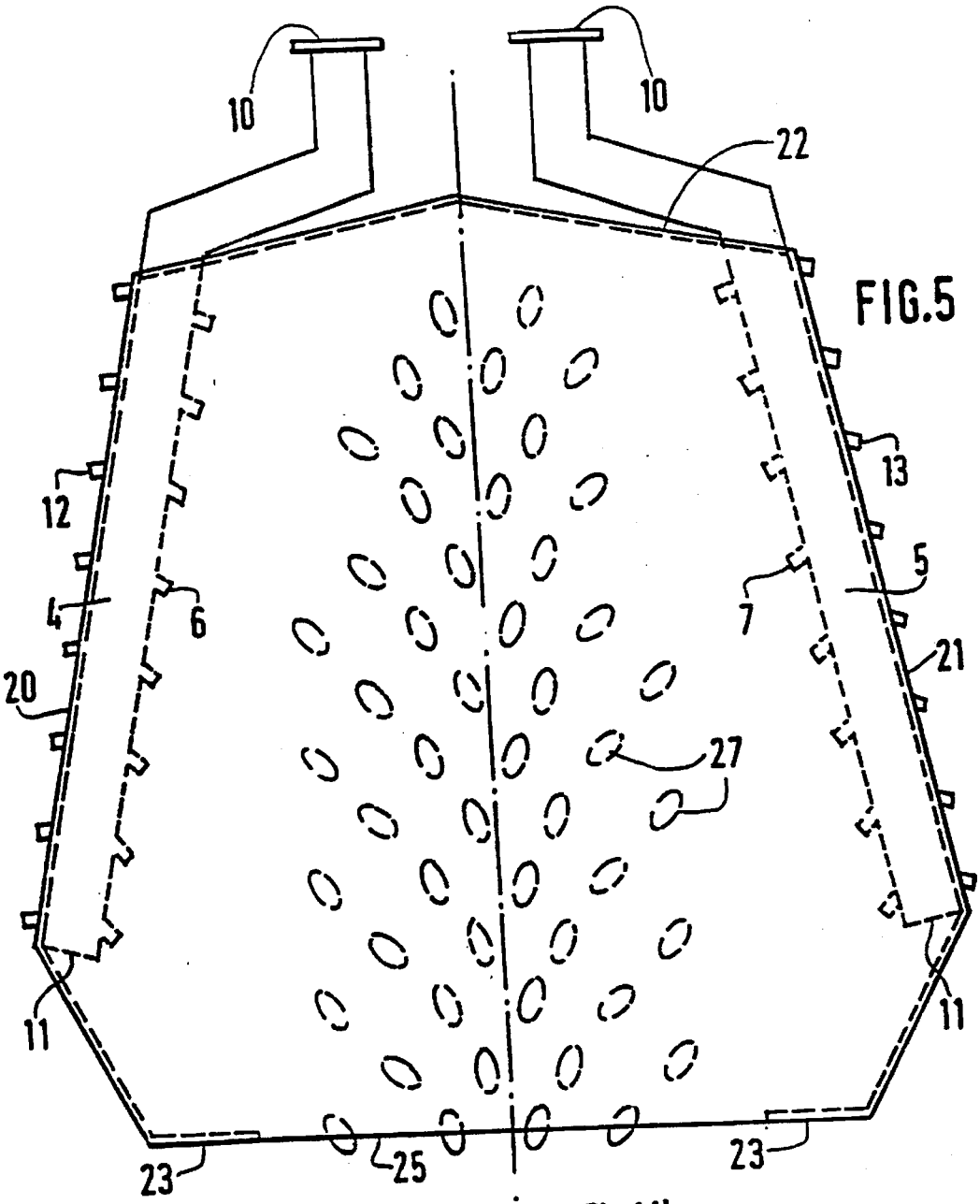
FIGS. 5 and 6 are diagrammatic plan and rear views of yet another embodiment of the device according to the invention.
Figure 6:
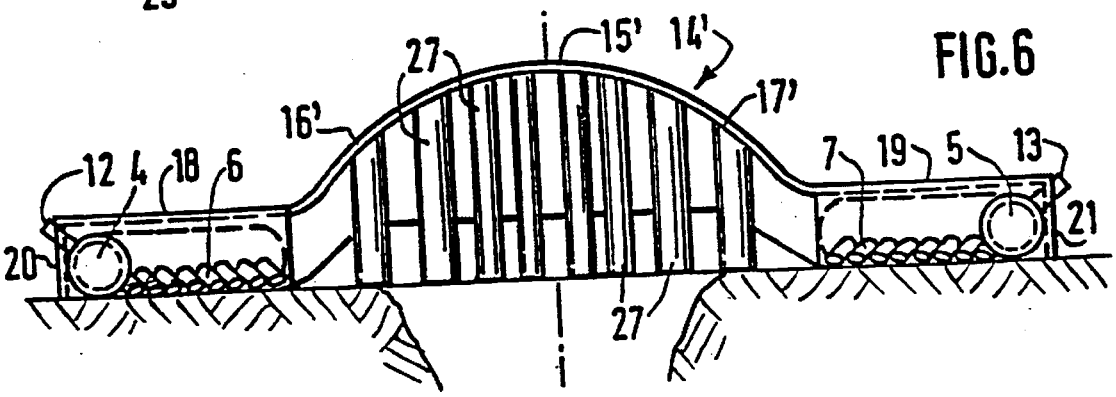

In the embodiment of FIGS. 5 and 6, the hood 14' exhibits a central part 15' and intermediate parts 16' which are curved and no longer flat as in the embodiments of FIGS. 3 and 4.

The device further includes structural elements 27 in the form of rods of elongate elliptical cross-section arranged in a staggered configuration, the major axes of the ellipses being arranged in varied orientations, so as to slow down the flows by forcing them to follow a winding path so as to promote the deposition of the constituent parts of ground in the trench.

The device is fed with pressurized water by at least one pump preferably installed in the moving chassis 9, which draws in seawater and is connected by a pipe to the end of the flanges 10. The water is thus conveyed by the conduits internal to the arms 4 and 5 with adequate flow rate and pressure values as far as the main nozzles 6, 7 which impart to the water flow the speed and kinetic energy allowing the deaggregation and entrainment of the ground by jetting effect as well as, if appropriate, to the balancing nozzles 12, 13. The parts of ground forming the sea bed thus deaggregated are dispersed and placed in suspension in the stream from the jets, forming a sort of emulsion which produces a stream of liquid sludge passing at high speed through two side spaces corresponding to the regions delimited by the side parts 18 and 19 of the hood. By passing through the central space of the device, that is to say the one delimited by the central part 15 of the hood, the rate of flow of the sludge is considerably reduced, which causes at least partial sedimentation of the particles of ground in suspension. The particles of ground are hence deposited in the trench, which thus begins to fill. As the opposed flows coming from the two sets of nozzles point obliquely backwards, especially at an angle of the order of 45°, the streamlines bend in progressively in the direction of the longitudinal axis of the device so that the liquid flow is entrained towards the back of the device along the trench 1 with a relatively low speed.

With the aim of limiting the bulk of the device, the length of the hood in the direction of the trench may be relatively restricted so that the liquid flow escaping beyond the hood towards the back above the trench still includes a greater or lesser proportion of ground in suspension. The spoil entrained is thus finally deposited in the trench downstream of the device so that the trench may be filled in completely, or almost, or with a certain excess thickness forming a ridge.

The dimensioning of the device is determined on the basis of the greatest cross-sectional dimensions that the trenches to be filled in may exhibit, and of the types of ground envisaged. It will be understood that all the parameters characterizing the device, such as geometric configuration and dimensions of the arms and of the hood, diameter, spacing and number of the calibrated orifices, flow rate and pressure of the water supplied by the pump or pumps may thus be optimized, case by case. These parameters are also correlated with the rate of progression that the moving chassis 9 imposes on the device. Since the cost of a filling-in operation is determined by its duration, the rate of progression may be increased by increasing the power of the jetting system and the length of the device and, conversely, the powerfulness of the device may be reduced, and its dimensions may be increased, particularly making it easier to handle, if a lower rate of progression is accepted.

The hood 14, 14', and the walls 20, 21, 22, 23 and likewise the central partition 26 may be made in the form of flat or curved plates made of a rigid metal or plastic, possibly stiffened so as to constitute a strong assembly.

In particular, they may be manufactured simply and economically from steel sheet.

All or some of the elements forming the hood, the walls and the partition may also be semi-rigid, more or less flexible, like membranes or even made of a completely flexible material such as fabric or canvas, made taut by elongate structural elements forming a frame, it being possible for the elongate structural elements to include the hollow arms for feeding the nozzles with water.

The apparent weight in water of the device may be reduced or even cancelled out by incorporating buoyancy elements (not represented) into it.

With the exception of the arms 4 and 5 conveying the pressurized water as far as the nozzles, the surfaces of these various elements are not necessarily leaktight. They may optionally exhibit a certain permeability, such as a fabric, the essential condition being that the flow rate of water passing through the surface under the effect of the flows created by the nozzles and the pressure differences should be nil or very low.

In an unillustrated alternative, some of the walls forming the hood 14, 14', particularly the central part 15, 15' may exhibit a plurality of elongate longitudinal openings parallel to the mid-plane of symmetry of the device over a substantial part of the length of the hood and with a relatively narrow width, like slits. In particular, the wall elements separating the contiguous longitudinal openings may be, not horizontal, but in the form of vertical or oblique elements of small thickness relative to their height, the assembly constituting a sort of grating thus exhibiting the appearance of meshwork. Such a device on the one hand makes it possible to facilitate the launching and descent of the device as far as the sea bed and, on the other hand, contributes to slowing down the flow in the central region above the trench.

In the examples illustrated, the hood and the walls attached thereto are fastened to the arms 4 and 5 which themselves are fastened to the moving chassis 9. As an alternative, it is the hood and the walls which are secured thereto and which can be fastened to the moving chassis.

In this case, it is possible, according to an unillustrated embodiment, to fix the nozzles on the external sidewalls 20, 21 or on the side parts 18, 19 of the hood. The device may thus not comprise hollow arms such as 4 and 5, it being possible for the pressurized water to be conveyed separately to each of the nozzles by separate conduits.

Figure 8:
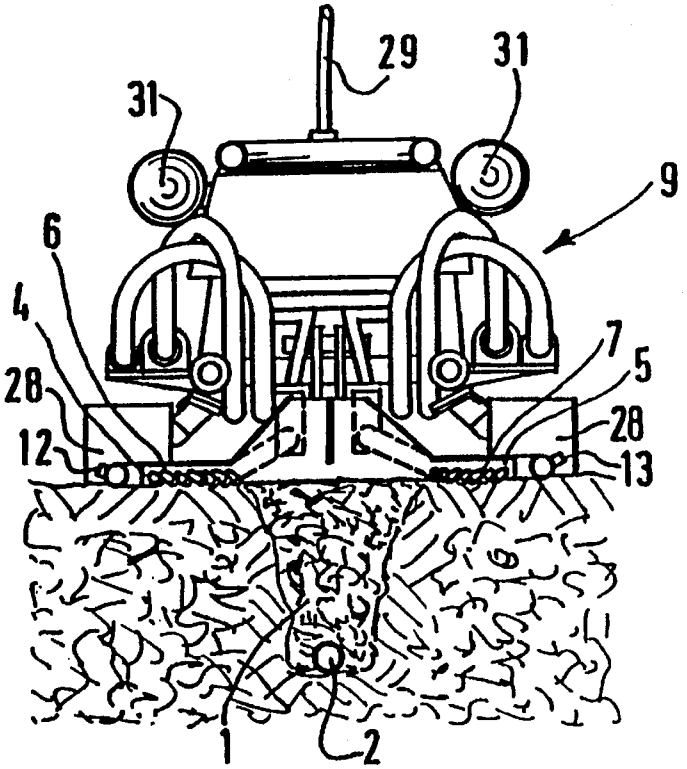
FIGS. 7 and 8 are respectively elevation and rear views of an underwater vehicle employing a device according to the invention.
Figure 7:
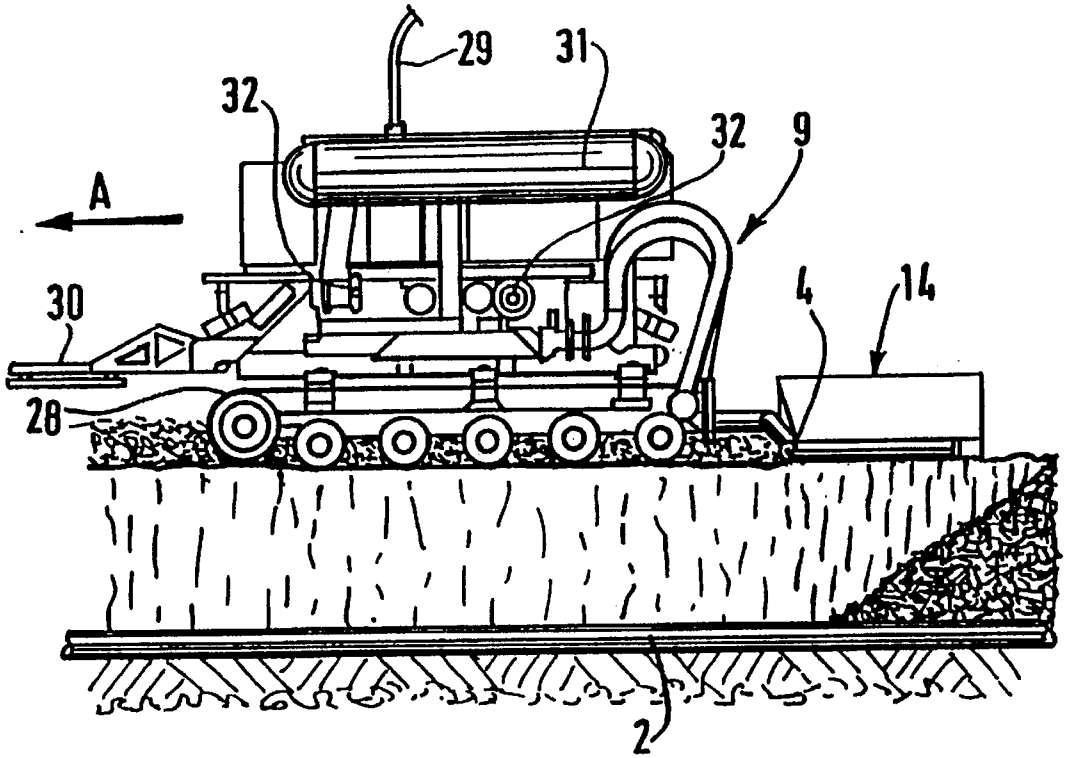

Reference is now made to FIGS. 7 and 8.

Therein is illustrated the device according to the invention corresponding to the embodiment of FIGS. 3 or 4 mounted on a moving chassis 9 consisting of equipment belonging to the applicant company and known by the name of FLEXJET, this equipment normally being equipped with arms with nozzles for digging a trench by deaggregating the ground in place and discharging the spoil formed backwards.

The equipment rests on two tracks 28 actuated by a hydraulic motor which causes the assembly to progress at a rate which may for example reach 200 or 300 meters per hour, and may, depending on the particular conditions of the operation, be reduced down to a few tens of meters per hour.

The electrical power and the feeding of the hydraulic circuits and all the control and measurement links are transmitted from the surface by an umbilical cord 29 connected to a vessel which remotely controls the operations.

Accurate driving of the equipment is achieved in particular by virtue of cameras as well as an identifying arm 30 arranged at the front and allowing the pipe 2 at the bottom of the trench 1 to be identified for example using electromagnetic or magnetic means.

The machine also includes navigational equipment as well as any identification means, such as acoustic beacons, ultrasound location systems, etc., making it possible to measure the position and orientation of the equipment accurately from the vessel.

The plant further comprises ballast tanks 31 which are partially or completely filled with water when it rests on the bed so that it has an apparent weight which allows it to obtain sufficient reaction of resting on the ground to balance out the propulsive force.

Alternatively, the moving chassis 9 may consist of equipment with zero apparent weight during the filling-in operation. Such equipment, operating on a principle similar to the equipment already known and used for digging trenches, is equipped with sufficient ballast for it to be possible to reduce the weight by emptying the ballast tanks so as to be exactly balanced by the thrust. Instead of being exerted via tracks resting on the sea bed, the horizontal forces necessary for positioning and progression of the plant are developed by propellers, such as propeller screws.

The assembly constituted by the plant and the device according to the invention is assembled beforehand on the surface, the device in the raised position being practically vertical, and is then launched from the vessel from which the operations are monitored, by a crane for example. During the operations of handling, launching, and descent to the sea bed, the ballast tanks are more or less emptied so that the apparent weight of the assembly in the water can be adjusted as desired, and set to the envisaged minimum value for the descent. The means for lifting the equipment, such as cables, may be cast off once launching has taken place and the equipment which remains connected to the vessel solely by the umbilical cord 29 can descend with the device "swimming" as far as the sea bed by virtue of the propellers 32 and position itself above the trench to be covered.

The invention makes it possible to fill in a trench having a depth which may reach 1.5 meters to 2 meters using a device 3 to 4 meters wide, with a water pressure in the nozzle-feed circuit of the order of 5 to 10 bar.

Although the invention has been described in conjunction with specific embodiments, it is quite clear that it is in no way limited thereto and that various alternatives and modifications may be made to it without thereby departing either from its scope or from its spirit.

We claim:

1. A trench-filling device for covering a pipe and filling in a trench dug in a sea bed, characterized in that the device comprises two sets of nozzles (6,7) arranged above and proximate to the sea bed on both sides of the trench (1), said nozzles pointing towards the sea bed and towards the trench and being fed with pressurized water to direct powerful jets of water into the ground making up the sea bed adjacent the trench in order to disintegrate and extract constituent parts of ground in place on each side of the trench and to create a stream of water laden with particles of said ground, said device also comprising guide means (14, 14') provided above to channel said streams so as to deposit into the trench constituent parts of the adjacent ground as the trench-filling device progresses along the trench.

2. Trench-filling device according to claim 1, characterized in that the two sets of nozzles (6, 7) are symmetric with respect to a plane (S) comprising the center line of the pipe to be covered.

3. Trench-filling device according to claim 1, characterized in that said nozzles (6, 7) have mouths situated at a height of less than 50 cm with respect to the sea bed.

4. Trench-filling device according to claim 1, characterized in that the axis of each nozzle makes an angle of between 5° and 80° with respect to the horizontal.

5. Trench-filling device according to claim 4, characterized in that said nozzles (6, 7) point backwards with respect to the direction of progression of the device.

6. Trench-filling device according to claim 1 characterized in that said nozzles (6, 7) form an angle between 5° and 80° with respect to a vertical plane perpendicular to the plane of symmetry (S).

7. Trench-filling device according to claim 6, characterized in that said nozzles (6, 7) form an angle of between 20° and 60° with respect to a vertical plane perpendicular to said plane (S) of the device.

8. Trench-filling device according to claim 1, characterized in that the device includes upright structural elements (27) arranged between the two sets of nozzles (6, 7), the height of said upright structural elements above the sea bed being less than half the transverse distance between the two sets of nozzles (6, 7).

9. Trench-filling device according to claim 1, characterized in that said guide means (14) comprise a set of guide nozzles which are fed with highly pressurized water.

10. Trench-filling device according to claim 1, characterized in that said guide means (14) comprise a cover (14, 14') covering the space delimited by the sets of nozzles (6, 7).

11. Trench-filling device according to claim 10, characterized in that the cover (14, 14') includes a central part (15, 15') connected to two side parts (18, 19) which extend as far as the sets of nozzles, the central part of the hood above the trench being arranged at a greater height than said side parts.

12. Trench-filling device according to claim 10, characterized in that the hood (14, 14') is supplemented on each side by two external sidewalls (20, 21) arranged outside the mouths of the sets of nozzles (6, 7).

13. Trench-filling device according to claim 10, characterized in that the cover (14, 14') is supplemented by a front wall (22) and a back wall (23) arranged between the front and back end edges of the cover and the sea bed.

14. Trench-filling device according to claim 13, characterized in that the front and back walls each include an opening (24, 25) in their central part.

15. Trench-filling device according to claim 10, characterized in that the device further includes a longitudinal central partition (26) arranged beneath said cover (14, 14') in its central part (15, 15'), the height of said partition (26) being not more than the heightwise gap separating the hood from the sea bed.

16. Trench-filling device according to claim 11, characterized in that each of the sets of nozzles (6, 7) is in the form of at least one row, and the rows of nozzles (6, 7) are arranged on either side of the trench, being symmetrical with respect to plane (S).

17. Trench-filling device according to claim 14, characterized in that the nozzles (6, 7) of one and the same row are mounted in line along a hollow arm (4, 5) and are arranged in a straight part of the arm.

18. Trench-filling device according to claim 17, characterized in that the anterior part of the hollow arms (4, 5) is open and is mounted at the back of a chassis (9) supporting the device and including at least one pump connected to said anterior part of the arms.

19. Trench-filling device according to claim 17, characterized in that said hollow arms (4, 5) are closed at the back (11).

20. Trench-filling device according to claim 1, characterized in that the trench-filling device includes balancing nozzles (12, 13) pointing towards the outside of the device and having an upwards and outwards inclination.

21. Trench-filling device according to claim 1, characterized in that the mouths of said nozzles (6,7) have mouths situated at a height of less than 10 cm with respect to the sea bed.

* * * * *